US010918229B1

(12) United States Patent
Mello

(10) Patent No.: US 10,918,229 B1
(45) Date of Patent: Feb. 16, 2021

(54) TRAVEL PILLOW CASE SYSTEM

(71) Applicant: Eileen Mello, Grass Valley, CA (US)

(72) Inventor: Eileen Mello, Grass Valley, CA (US)

( * ) Notice: Subject to any disclaimer, the term of this patent is extended or adjusted under 35 U.S.C. 154(b) by 305 days.

(21) Appl. No.: 15/984,254

(22) Filed: May 18, 2018

Related U.S. Application Data

(60) Provisional application No. 62/507,785, filed on May 18, 2017.

(51) Int. Cl.
*A47G 9/02* (2006.01)
*A47G 9/04* (2006.01)
*A47G 9/10* (2006.01)

(52) U.S. Cl.
CPC ..... *A47G 9/0253* (2013.01); *A47G 9/04* (2013.01); *A47G 9/1045* (2013.01); *A47G 9/1081* (2013.01)

(58) Field of Classification Search
CPC ..... A47C 7/383; A47C 7/386; A47G 9/0253; A47G 9/04; A47G 9/1045; A47G 9/1081
See application file for complete search history.

(56) References Cited

U.S. PATENT DOCUMENTS 5,184,362 A 2/1993 Yager et al.
5,313,678 A * 5/1994 Redewill ..... A47C 21/003 297/393
6,009,577 A 1/2000 Day
2004/0200004 A1* 10/2004 Matthews Brown .. A47D 13/08 5/655
2005/0155152 A1* 7/2005 Coats ..... A47C 7/383 5/636
2013/0227784 A1* 9/2013 Holliday ..... A47G 9/0253 5/490
2015/0314715 A1* 11/2015 Kilgore ..... A47C 7/383 5/636
2016/0007774 A1* 1/2016 Kakabeeke ..... A47G 9/0246 5/496
2017/0020313 A1* 1/2017 Sanh ..... F16M 11/40
2018/0168356 A1* 6/2018 Porowski ..... A47G 9/1081
2018/0344047 A1* 12/2018 Pettersson ..... A47C 27/081

OTHER PUBLICATIONS

May 12, 2017 "An Eco-friendly Bag, iconic and versatile" All pages perinent. (Year: 2017).*

(Continued)

*Primary Examiner* — David R Hare
*Assistant Examiner* — Adam C Ortiz
(74) *Attorney, Agent, or Firm* — Knobbe Martens Olson & Bear LLP

(57) ABSTRACT

A pillow case system is provided, comprising a pillow cover portion (e.g. a curvilinear envelope) with a first cavity, a securement system, and a storage portion (e.g. a tote bag) with a second cavity. The first cavity is operable for receiving a travel pillow (e.g. a neck pillow). The storage portion is attached to the pillow cover portion. The storage portion is configured to receive the entire pillow storage portion in the second cavity. The securement system secures the pillow in the pillow cover portion when the pillow case system is in a first, open configuration. The securement system may also or alternatively secure the pillow cover portion in the storage portion when the pillow case system is in a second, stowed configuration.

11 Claims, 7 Drawing Sheets

(56) References Cited

OTHER PUBLICATIONS

ChicoBag website, Compact Reusable bags, packs, and totes (https://www.chicobag.com/), printed on May 17, 2018, 4 pages.
Amazon website, Comfort Pal Memory Foam Travel Pillow with Elastic Strap and Carry Case—Suitable for Airplane, Bus, Train, Car or Home Use—Molds to the Neck for Extra Comfort—Includes Removable Pillow Cover (https://www.amazon.com/Comfort-Pal-Travel-Pillow-Elastic/dp/B00WTQ333O/ref=sr_1_2_sspa?ie=UTF8&qid=1526397466&sr=8-2-spons&keywords=u-neck+pillow+case&psc=1), printed on May 18, 2018, 9 pages.
Amazon website, Langria Memory Foam Neck Pillow Ergonomic Contoured U-Shape Travel Pillow with Adjustable Neck Size Washable Cover for Plane Train Car Bus Office (Striped Arctic Blue) (https://www.amazon.com/LANGRIA-Ergonomic-Contoured-Adjustable-Washable/dp/B076DFLHX3/ref=sr_1_9?ie=UTF8&qid=1526397466&sr=8-9&keywords=u-neck+pillow+case) , printed on May 18, 2018, 10 pages.

* cited by examiner

TRAVEL PILLOW CASE SYSTEM

CROSS-REFERENCE TO RELATED APPLICATION

This application claims the priority benefit of U.S. Provisional Patent Application No. 62/507,785, filed on May 18, 2017, the entire contents of which are hereby incorporated by reference into this application.

BACKGROUND

Field

This invention relates generally to accessories for pillows, such as personal travel pillows (e.g., U-neck pillows, horse shoe-shaped neck pillows, boomerang-shaped neck pillows, travel neck pillows, etc.), and specifically to washable pillow cases for pillows.

Related Art

Travel can be tiring, uncomfortable and even dirty. Regardless of whether a passenger is traveling via airplane, train or vehicle, a pillow may be used to make the journey more comfortable and restful. Neck pillows are often used during travel, especially during long flights or train rides to help with resting more comfortably.

SUMMARY

In some embodiments, a pillow case system comprises a pillow cover portion (e.g., curvilinear envelope) with a first cavity, a draw string around a first opening of the first cavity of the curvilinear envelope, a cord lock, a storage portion with a second cavity, and an integrated attachment system that may include an attachment component (e.g., a carabiner clip) that is attached to the pillow case system via an attachment member (e.g. a loop). The first cavity is capable of receiving a neck pillow. The curvilinear envelope may be made entirely of recycled and washable material. The draw string tightens the first opening of the first cavity from a first open position to a first closed position. The cord lock secures the draw string in the first closed position. The storage portion is attached to the curvilinear envelope. The storage portion is configured to receive the entire curvilinear envelope into the second cavity. The draw string can also tighten the second opening of the second cavity from a second open position to a second closed position.

In some embodiments, a pillow case system comprises a pillow cover portion (e.g., curvilinear envelope) with a first cavity, a securement system, and a storage portion with a second cavity. The first cavity is operable for receiving a neck pillow. The storage portion is attached to the curvilinear envelope. The storage portion is configured to receive the entire curvilinear envelope in the second cavity.

BRIEF DESCRIPTION OF THE DRAWINGS

Certain embodiments of the disclosed technology will now be discussed in detail with reference to the following figures. These figures are provided for illustrative purposes only and the disclosed technology is not limited to the subject matter illustrated in the figures. For example, the labels and descriptions in text and in the drawings are examples only and should not be understood to limit the usage, materials, function, applicability, or any other aspect of the inventions disclosed herein. Rather, such labels and descriptions should be viewed as disclosing some examples of embodiments of a broader genus of structures and features that may or may not comprise specific attributes set forth in text in the drawings.

DETAILED DESCRIPTION OF EMBODIMENTS

Figure 1B:
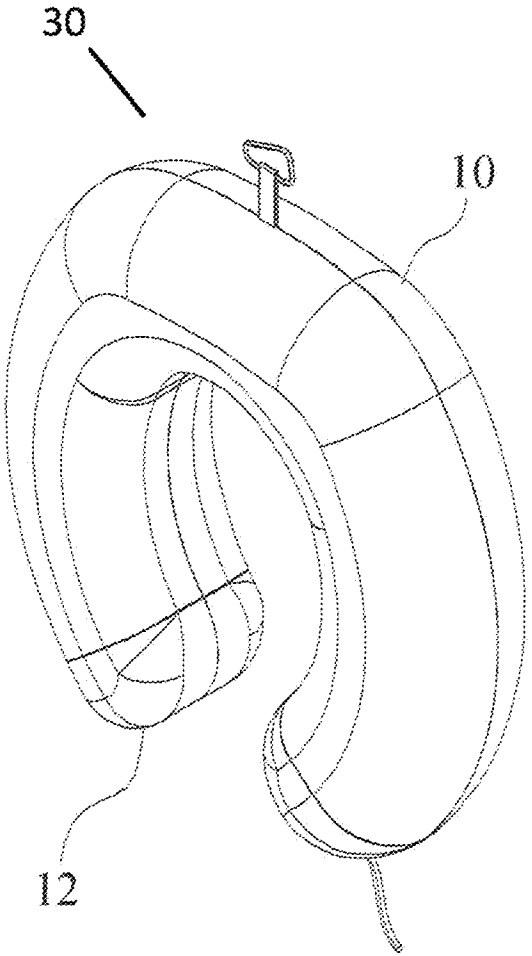
FIG. 1B illustrates an isometric view of an example of the pillow case system when the pillow is inserted inside according to one embodiment of the disclosed technology.

The present disclosure is directed to a pillow case system for travel pillows. More specifically, aspects of the present disclosure relate to a removable, collapsible case for a travel pillow (e.g., a neck pillow). The case may have an integrated storage portion (e.g., a tote bag). The integrated storage portion may provide protection and self-storage for the case, and facilitate portability of the case. In some embodiments, the case may include a securement component (e.g., a draw string, elastic string, zipper, button(s), adhesive surface, hook-and-loop surface, etc.) that secures a travel pillow within the case during use. The securement component may also, or alternatively, secure the case within the storage portion when the case is not in use with a travel pillow. In some embodiments, the case may include an integrated attachment member, such as a loop, tag or hook. The loop can be made of fabric, nylon, REPREVE®, or another material. In some embodiments, the case may include an attachment component (e.g., a carabiner, clip, button, hook, etc.) that attaches the case to a second object. The attachment component may facilitate attachment of the case to a second object while the case is in use with a travel pillow and/or when the case is not in use. The integrated attachment member (e.g. loop) can facilitate attachment of the attachment component to the pillow case system such that the pillow case system can be attached to other objects, such as the outside of purses, luggage or other travel bags.

Pillows are often used for, among other things, comfort during travel. The dirt and germs on a bed pillow provided in hotels or those offered on commercial airline flights also give cause for concern. The use of a personal pillow can address these conditions with potentially limited comfort and presents practical difficulties. A conventional bed pillow is not easily carried on one's person and would take up a substantial amount of the very limited space typically available to the traveler in her luggage. For this reason, most travelers desire the use of a travel-friendly pillow, such as a neck pillow, while traveling in an airplane, a train or vehicle, in route and/or upon arriving at overnight lodgings. In addition, a neck pillow can, in general, enhance travel comfort in many circumstances where a pillow is desired but not typically provided, such as while traveling in a vehicle, or waiting for a night in an airport or for a train at the station.

Generally described, a neck pillow is a curved pad typically used to support the head and/or neck of user, often when the user is sitting upright. A neck pillow is typically shaped so as to wrap around the back and sides of a user's neck. For example, the neck pillow may be substantially semicircular, such as a U-shaped pillow, a horseshoe-shaped pillow, a parabolic-shaped pillow, etc. The pad may be made of feathers, foam, fabric, gel, or the like. In some cases, the pad is wrapped in a non-removable or semi-permanent cover.

When purchasing a neck pillow, most consumers do not consider that it quickly becomes unsanitary during transit both to and from their destination and while waiting for their transportation. There are many companies that sell neck pillows for travelers. Such pillows solve the problems of availability but not cleanliness. Washing the pillow is not a solution for the germs the pillow has accumulated during transit and before being used during transport. Additionally, some travelers will not have the ability to wash the pillow while on vacation, yet will want to use their neck pillow again on their return journey home. If they have been traveling with the pillow for days, weeks—and in some instances, months—then the pillow is likely to be very dirty or otherwise have collected a substantial number of germs.

A potential solution to the problem is for a traveler to pack a separate pillowcase in her carry-on luggage. This solution allows the traveler to place a barrier between the pillow and her skin, providing some degree of protection from dirt and other surface contaminants. However, cotton pillowcases do not provide sufficient protection against the spread of germs to protect the traveler from infection.

Therefore, there is a need for a product that solves the problem of availability, cleanliness and sanitary integrity of neck pillows and/or pillows that are given to travelers by a carrier that provides the traveler with both a clean and comfortable surface upon which to rest her head but does not take up valuable luggage space and does not require the traveler to pack and unpack items multiple times.

The pillow case system disclosed herein can prevent pillows from being exposed to a variety of environmental toxins and germs, found everywhere from airport security x-ray machines to restrooms, transportation vehicles and floors. Some aspects of the disclosure provide an integrated storage portion, such as a pillow tote bag. For example, the pillow case system may act as a protective cover for an existing pillow and can be easily folded and/or collapsed into itself when not in use. In some embodiments, the storage portion can be adjustable.

Additional aspects of the disclosure provide a pillow case system that will appeal to environmentally and socially responsible consumers. The pillow case system can be made from 100% recycled materials and may be manufactured in compliance with fair labor and workplace standards throughout the entire supply chain. Thus, the pillow case system can help curb landfill waste of neck pillows. For example, the pillow case system saves consumers from having to frequently wash their neck pillows, thereby deteriorating the material and limiting its lifespan. Furthermore, the pillow case system eliminates consumers' disposing of their neck pillows due to an inability to properly sanitize the pillows. In some embodiments, making a pillow case system with a minimum number of steps and from a minimum number of component materials is contemplated. In some embodiments, the pillow case system is made from a single sheet of fabric.

Further aspects of the present disclosure provide an attachment component, such as a carabiner clip, for attaching the encased pillow to other objects, such as the outside of purses, luggage or other travel bags, thereby conserving precious space in traveler's limited hand luggage and for easy access.

The pillow case system is transformable between a compact, folded, first configuration (also referred to as the "stowed" configuration) when not in use to an unfolded and open second configuration (also referred to as the "open configuration") where it functions as a pillow case, able to accept a travel pillow. A pillow may be inserted into the pillow case system so that the pillow is completely protected regardless of its size.

Furthermore, in some embodiments, the curvilinear envelope can fit neck pillows of various sizes, including those that are asymmetrical. For example, the asymmetrical neck pillows could include those that have protruding portions (e.g., cartoon or animal characters that extend outward from a surface of the of the neck pillow) on only one side or end, those that have protruding portions on both sides or ends, those that have protruding portions at one or more locations in between the ends of the pillow, etc. Illustratively, the protruding portions may be shaped like a fish, dolphin, face, object, or the like. The curvilinear envelope can be one-size-fits-all such that both symmetrical and asymmetrical neck pillows, including those with one or more protruding portions, can be inserted into the curvilinear envelope.

The following detailed description is now directed to certain specific examples of embodiments of the disclosure. In this description, reference is made to the drawings wherein like parts are designated with like numerals throughout the description and the drawings. The inventions are not limited to examples expressly limited or described in this specification. Various examples of pillow case system are illustrated in the drawings and/or described in the text of this specification. Although the examples described herein focus on use of the pillow case system with a neck pillow, the examples are illustrative only, and are not intended to be limiting. In some embodiments, the pillow case system may be used with other pillows, such as orthopedic pillows, nursing pillows, and the like.

Any feature, structure, step, material, or component that is illustrated and/or described in any embodiment in this specification can be used separately from the embodiment in which it is disclosed and/or illustrated, either individually, or in combination with another embodiment described and/or illustrated in this specification, or in combination with any embodiment that is not described and/or illustrated in this specification. For example, without limitation, any embodiment in this specification can include a draw string, elastic band, cord lock, loop or other features, even if not illustrated or described, and/or any embodiment in this specification can be configured to be put on a neck pillow or other pillow, rolled into an integrated or separate storage portion (e.g., a tote bag), and/or attached to another item. Furthermore, without limitation, any embodiment of this specification can be configured to be washable, made of 100% recycled material, and made in compliance of fair labor standards. For example, the 100% recycled material may comprise REPREVE®. In some embodiments, the draw string and the cord lock are not made of recycled material. No feature, structure, step, material, or component disclosed and/or illustrated in this specification is essential or indispensable.

Figure 1A:
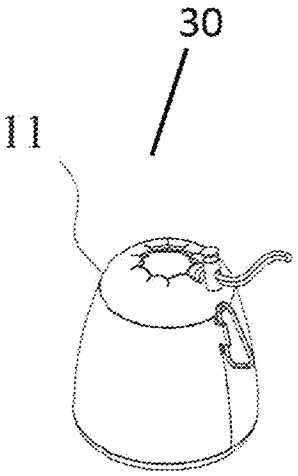
FIG. 1A illustrates a three-dimensional view of an example pillow case system when it is in a first, stowed configuration according to one embodiment of the disclosed technology.

With reference to an illustrative embodiment, FIGS. 1A and 1B illustrate a pillow case system 30 that may include a pillow cover portion 10 and a storage portion 11. The pillow cover portion 10 may be a curvilinear envelope with a first cavity, which is operable for receiving a neck pillow 12. The curvilinear envelope can be made entirely from one sheet, or two sheets, or more than two sheets of material. In some embodiments, the curvilinear envelope can be made from washable and recycled and/or recyclable material. The storage portion 11 may have a second cavity, which can be configured to receive the entire curvilinear envelope when the pillow case system 30 is in the stowed configuration, as shown in FIG. 1A.

The storage portion 11 (e.g., tote bag) can be attached on the edge of the pillow case portion 10. The storage portion 11 may be coupled to or integrated with the pillow case portion 10. For example, the storage portion 11 can be sewn onto the curvilinear envelope, glued onto the curvilinear envelope, both sewn onto and glued onto the curvilinear envelope, etc. The storage portion 11 can protrude from the perimeters of the curvilinear envelope, or it may be attached such that it is completely within the perimeter of the curvilinear envelope. For example, the perimeter of the storage portion 10 may be completely within the perimeter of the curvilinear envelope 10 such that there is an overlap. In some embodiments, the storage portion 11 can be attached such that it is partially within the perimeter of the curvilinear envelope 10. For example, the perimeter of the storage portion 11 is partially within the perimeter of the curvilinear envelope 10 such that there is an overlap.

The pillow cover portion 10 (e.g., curvilinear envelope) can be made of washable, recycled, and/or recyclable material. The pillow cover portion 10 can receive a neck pillow 12. For example, if the pillow cover portion 10 is a curvilinear envelope, the curvilinear envelope may have a first cavity. The curvilinear envelope 10 can be made entirely of one sheet of material, and the first cavity would be defined by an opening in a first sheet of material. The curvilinear envelope 10 can be made of two sheets of material, and the first cavity would be defined by the inner surface of a first sheet and an inner surface of a second sheet of material. The curvilinear envelope 10 can be made of more than two sheets of material, and the first cavity would be defined by a three-dimensional area (e.g., a void, compartment, chamber, etc.) formed by these sheets of materials.

In some embodiments, the pillow case system 30 includes one or more securement components, such as draw strings and cord locks. For example, one draw string and one cord lock can tighten both the first cavity and the second cavity. As another example, a first draw string and a first cord lock can tighten the first cavity while a second draw string and a second cord lock can tighten the second cavity. In some embodiments, the pillow case system 30 does not comprise any securement components.

The term "draw strings" in this specification is used in its ordinary sense, and includes cords, laces, or fabric that can be made of cotton, elastic materials, or another material. The draw strings can further be tightened using a "cord lock", which in this specification is used in its ordinary sense. The cord lock can be made of plastic, metal or another material. The pillow case system 30 may include two draw strings and two cord locks, only one draw string and one cord lock, no draw string and no cord lock, etc. In some embodiments, the pillow case system 30 comprises more than two draw strings and more than two cord locks. A draw string can tighten an opening from an open position to a closed position. For example, a draw string can tighten the first opening of the first cavity of the curvilinear envelope from a first open position to a first closed position, thus securing a neck pillow 12 inside the pillow cover portion 10. As another example, the draw string can tighten the second opening of the second cavity of the storage portion 11 from a second open position to a second closed position, thus securing the pillow cover portion 10 inside the storage portion 11.

In some embodiments, an elastic system can replace the draw string and cord lock. For example, the elastic system is used to keep an opening of pillow case system 30 tightened shut once the neck pillow is inserted. As another example, the elastic system is used to tighten the storage portion when the pillow case system is in a closed, rolled-in configuration. In some embodiments, an elastic system can be used in conjunction with the one or more draw strings or cord locks.

In some embodiments, the pillow case system 30 includes an attachment system. For example, an integrated attachment member, such as a loop made of fabric, plastic, metal, or some other material, may be positioned in the middle of the pillow case system 30. In some embodiments, the attachment system further comprises an attachment component, such as a carabiner hook, that can be used to clip onto another object. For example, a carabiner hook may be coupled to the pillow case system 30 via a loop.

The term "loop" in this specification is used in its ordinary sense, and can be attached to the curvilinear envelope. In some embodiments, the loop can be sewn onto the curvilinear envelope, glued onto the curvilinear envelope, both sewn onto and glued onto the curvilinear envelope, etc. In some embodiments, the loop can protrude from the perimeters of the curvilinear envelope. For example, the loop can be attached such that it is completely within the perimeter of the curvilinear envelope. The loop can be attached such that it is partially within the perimeter of the curvilinear envelope.

The loop can be sewn or glued onto the storage portion. In some embodiments, there are two loops, one on the curvilinear envelope and one on the storage portion. In some embodiments, there is only one loop. For example, when there is only one loop, the loop can be sewn or glued onto only the curvilinear envelope, or only onto the storage portion, or onto both the storage portion and the curvilinear envelope when the curvilinear envelope and the storage portion overlap.

The securement system can be removably attached to the pillow cover portion 10 or permanently or semi-permanently attached to the pillow cover portion 10. For example, the securement system can freely slide around the curvilinear envelope when the securement system is not tightened. As another example, the securement system can be sewn or glued onto the curvilinear envelope. The securement system can be used to secure positioning of the neck pillow when it is inserted into the curvilinear envelope. For example, the securement system can be placed substantially in the middle of the curvilinear system and when the securement system is tightened, the pillow's shape is secured according to the shape of the curvilinear envelope. The securement system can comprise multiple layers of draw strings and one cord lock. In some embodiments, the securement system can comprise multiple layers of elastic bands.

Referring to FIGS. 1A-1B, an example of a pillow case system 30 is illustrated in two different views. FIG. 1A illustrates the pillow case system 30 when the pillow case system 30 is in a first, stowed configuration, inserted inside the storage portion 11. FIG. 1B illustrates the pillow case system 30 in a second, open configuration when a pillow 12 is inserted inside curvilinear envelope 10.

Figure 2:
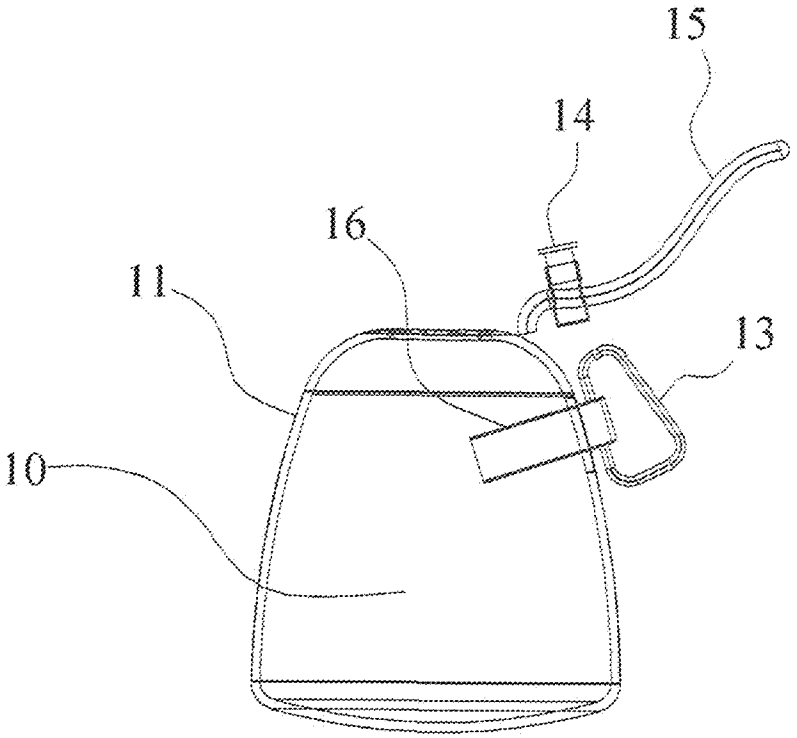
FIG. 2 illustrates a cross-sectional view of an example of the pillow case system in a first, stowed configuration according to one embodiment of the disclosed technology.

FIG. 2 illustrates a cross-sectional view of an embodiment of the pillow case system 30 in a first, stowed configuration such that the curvilinear envelope 10 is inserted inside the storage portion 11. An integrated attachment member (e.g., loop) 16 is attached to the storage portion. A carabiner clip 13 is attached to the loop 16. A draw string 15 is attached to the opening of the storage portion. A cord lock 14 is attached to secure the draw string 15 as well as the curvilinear envelope 10 that is contained inside the storage portion 11. Though the illustration depicts a cord lock 14 and draw string 15, in some embodiments the opening of the pillow case system 30 may be closed or otherwise tightened via any securement system 20. For example, the securement system 20 may be a plurality of loops of plastic bands or an elastic system. The securement system 20 can secure the pillow in a set location within the pillow case system 30.

As noted herein, the pillow case system 30 can comprise multiple draw strings, multiple cord locks, or multiple loops. The pillow case system 30 can also comprise one draw string, one cord lock, or one loop. The pillow case system 30 can also comprise no draw string, no cord lock, or no loop.

The pillow case system 30 can optionally comprise a carabiner clip 13. In some embodiments, the pillow case system 30 does not comprise a carabiner clip 13. In some embodiments, another device, such as a twist lock, or a key ring is used to secure the pillow case system 30 to another item such as a back pack, a suit case, a tote bag, or a hand bag.

Figure 3:
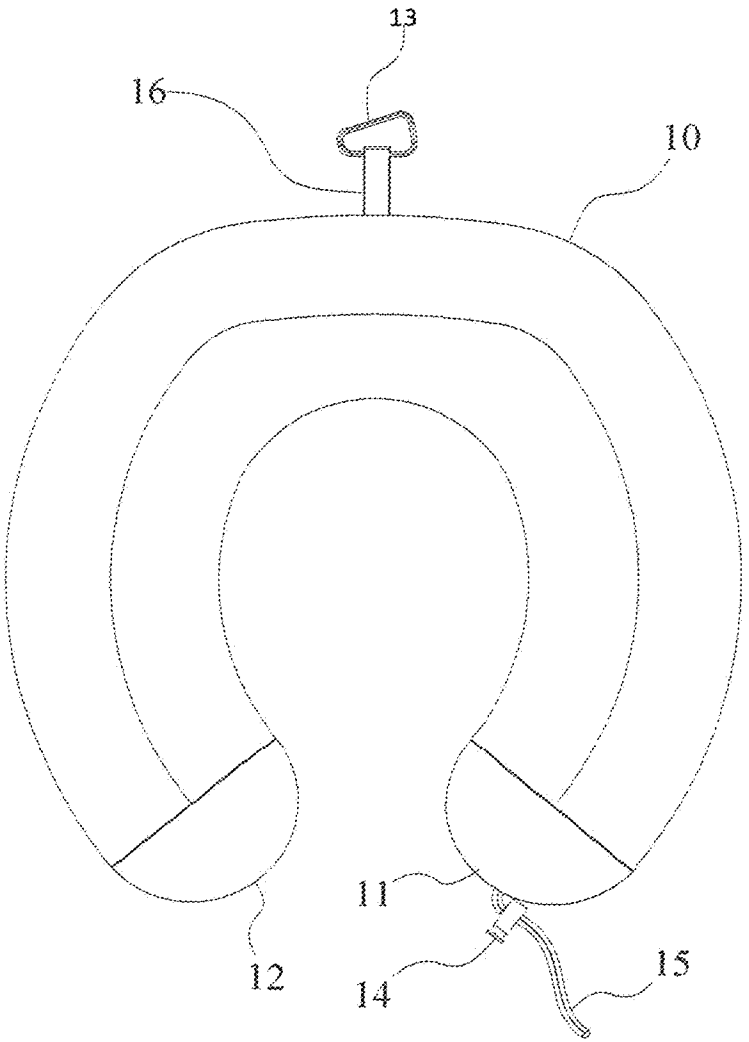
FIG. 3 illustrates a top-down view of an example of the pillow case system in a second, open configuration when a neck pillow is inserted according to one embodiment of the disclosed technology.

FIG. 3 illustrates a top-down view of an embodiment of the pillow case system in a second, open configuration when a neck pillow 12 is inserted. The loop 16 is attached such that the perimeters of the loop are outside the perimeters of the curvilinear envelope 10. Furthermore, the loop 16 is placed in the middle of the curvilinear envelope 10 such that it is equidistant from the left-most edge and the right-most edge of the curvilinear envelope 10. Furthermore, a carabiner clip 13 is attached to the loop 16. A securement system 20, such as a draw string 15 and a cord lock 14, are attached to the storage portion 11.

In some embodiments, the loop 16 can be placed equidistant from the left-most edge and the right-most edge of the curvilinear envelope 10 such that the weight of the pillow is equally distributed when the pillow case system 30 is hung. In some embodiments, the loop 16 can be placed in a position that is different than the center and is not equidistant from the left-most edge and the right-most edge of the curvilinear envelope 10. For example, the loop can be placed entirely on the left side of the curvilinear envelope. As another example, the loop can be placed entirely on the right side of the curvilinear envelope.

Figure 4B:
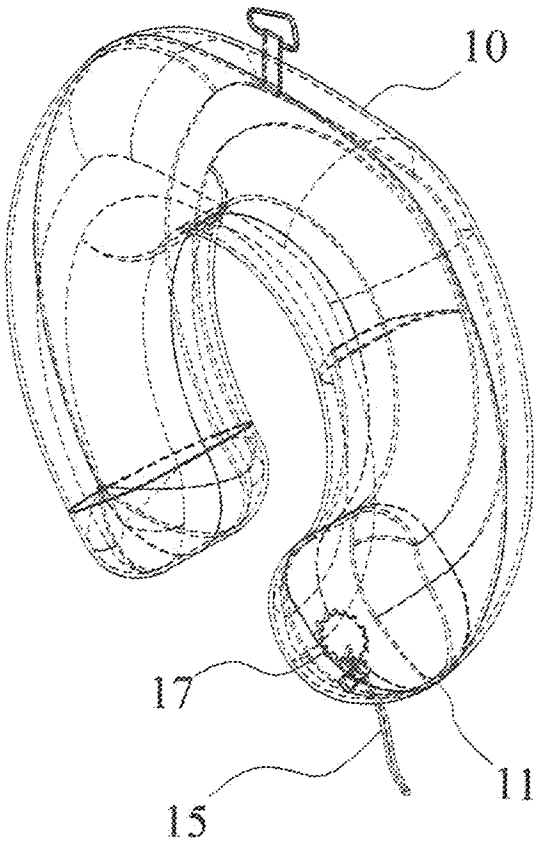
FIG. 4B illustrates an example of the pillow case system in a perspective view when the pillow case system is in a second, open configuration.
Figure 4A:
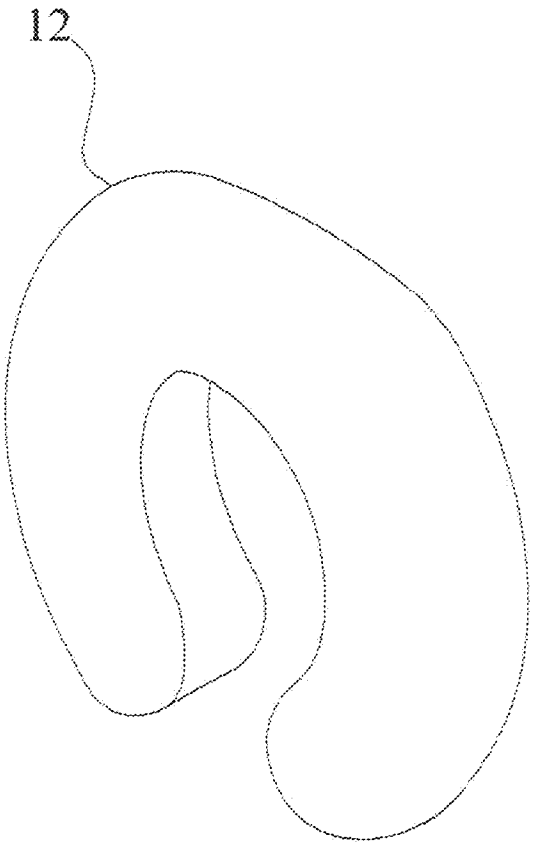
FIG. 4A illustrates an example of a neck pillow that can be inserted into the pillow case system.

FIG. 4A illustrates a neck pillow 12 that can be inserted into the curvilinear envelope 10. The neck pillow can comprise: a U-neck pillow, a horse shoe-shaped pillow, a boomerang-shaped pillow, a pillow with two edges that are perpendicular to each other, or a pillow with two edges that curve in opposite directions.

FIG. 4B illustrates an example of the pillow case system in a perspective view when the pillow case system is in a second, open configuration. The curvilinear envelope ends in an opening 17 on one side. A draw string 15 can tighten the opening 17. In some embodiments, the storage portion 11 may be drawn or placed inside the pillow cover portion 10 when the pillow cover portion 10 is in the second, open configuration such that the storage portion 11 cannot be seen from the outside when the pillow 12 is inserted and the drawing 15 is tightened around the opening 17. In some embodiments, the storage portion 11 can be seen when viewed from the outside when the pillow is inserted and the draw string is tightened.

Figure 5:
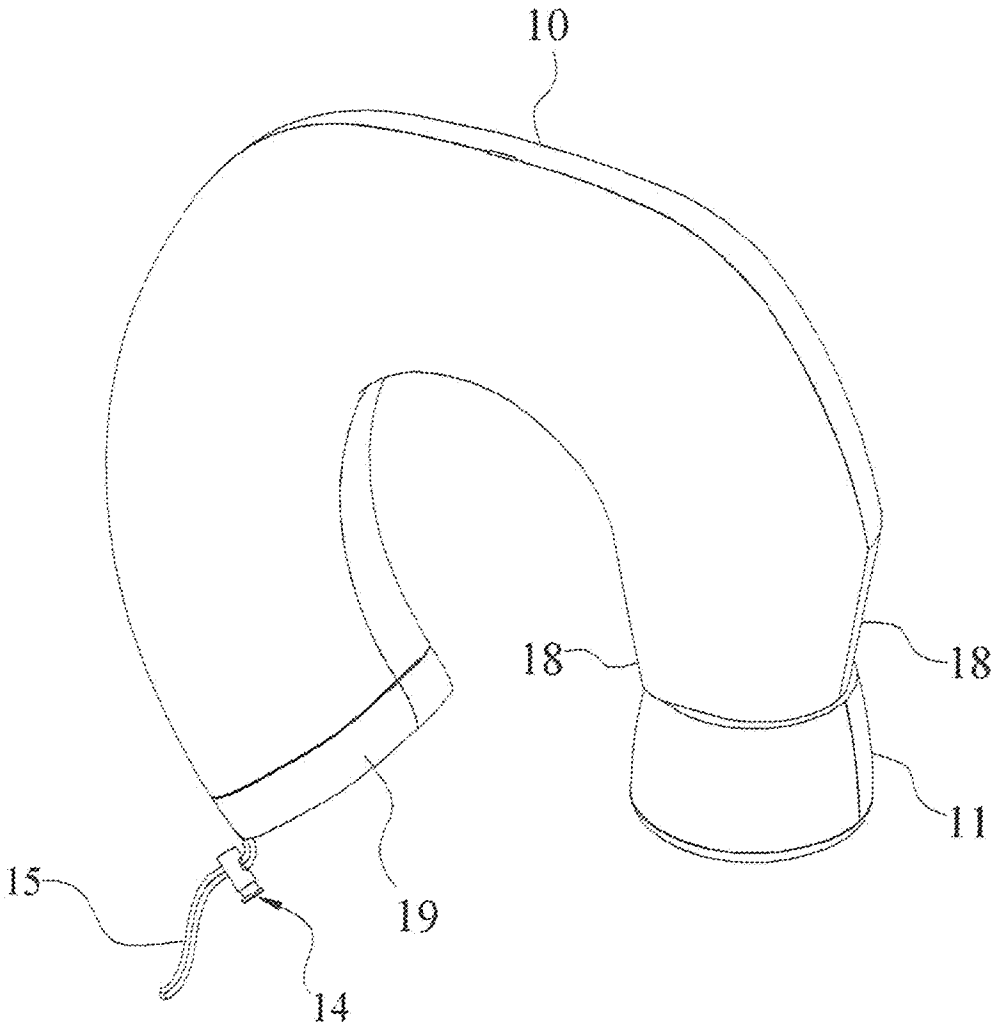
FIG. 5 illustrates an example of the pillow case system in transition between the second, open configuration and the first, stowed configuration.

FIG. 5 illustrates an example of the pillow case system 30 in transition between the second, open configuration and the first, stowed configuration. The storage portion 11 can be seen. In some embodiments, the storage portion 11 may be inside-out when the pillow case system 30 is in the second, open configuration and during at least a portion of the transition to and/or from the first, stowed configuration. Furthermore, a transition 18 between the curvilinear envelope 10 and the storage portion 11 is shown.

A draw string 15 may be sewn around the inside opening 19 and a cord lock 14 is used to secure the draw string 15. Although not shown in FIG. 5, an opening 17 would be shown if the sides of pillow case system are flipped.

Figure 6:
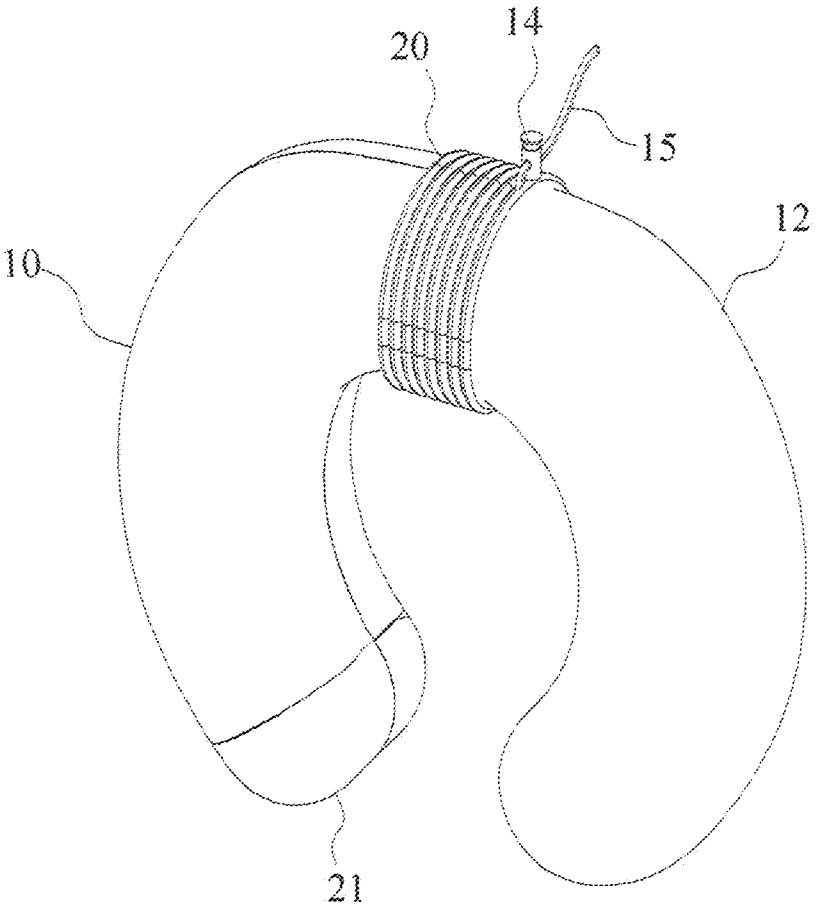
FIG. 6 illustrates an example of the pillow case system in a second, open configuration with the neck pillow inserted inside according to one embodiment of the disclosed technology.

FIG. 6 illustrates an example of the pillow case system in an unpacked, open configuration with the neck pillow inserted inside. A securement system 20 is placed in the middle of the pillow case system. The securement system 20 is capable of securing the pillow inside the curvilinear envelope. The securement system 20 can further comprise a draw string 15 and a cord lock 14, a plurality of elastic bands, an elastic system, or any other system to secure the pillow in a set position within the pillow case system. The bottom 21 of the curvilinear envelope secures the bottom of the pillow 12.

Figure 7B:
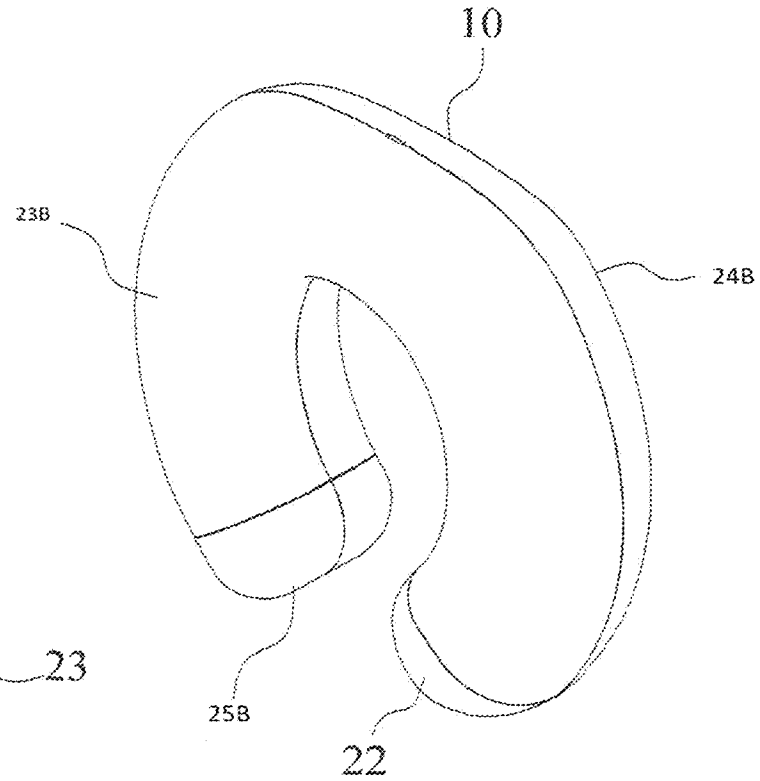
FIG. 7B illustrates a view of an example of the pillow case system according to one embodiment of the disclosed technology.
Figure 7A:
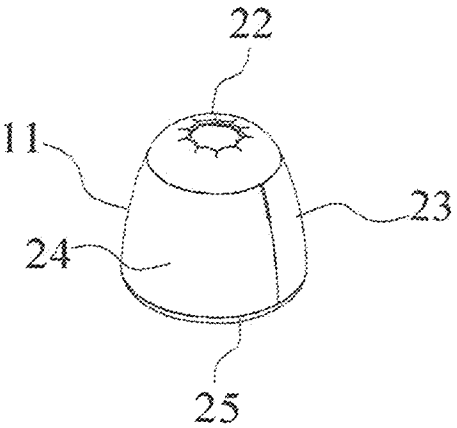
FIG. 7A illustrates a three-dimensional view of an example of the pillow case system when it is in a first, stowed configuration according to one embodiment of the disclosed technology.

FIG. 7A illustrates an example of a three-dimensional view of the pillow case system. A top flap 22 may obscure or replace a draw string and a cord lock system, or any other securement system 20, as illustrated. A first side wall 23, a second side wall 24 and a bottom wall 25 are coupled together to form the storage portion 11.

FIG. 7B illustrates an example of the pillow case system 30 in FIG. 7A when it is rolled-out, unpacked and open. In some embodiments, the pillow case system 30 may be inverted into an inside-out orientation with respect to the orientation when in the first, stowed configuration shown in FIG. 7A. The same flap 22 is shown. The curvilinear envelope 10 also comprises a side wall 23B, side wall 24B and bottom wall 25B.

Example 1

A pillow case system comprises a curvilinear envelope with a first cavity, a storage portion with a second cavity, a first loop on the curvilinear envelope and a second loop on the storage portion. A first draw string and a first cord lock can tighten the first cavity. A second draw string and a second cord lock can tighten the second cavity. The perimeters of the storage portion partially, but not entirely, overlaps with the perimeters of the perimeters of the curvilinear envelope. The curvilinear envelope can receive a U-neck travel pillow when the curvilinear envelope is in an second, open configuration. When the curvilinear envelope is in a first, stowed configuration, the curvilinear envelope can be fitted inside the storage portion. The pillow case system, including the curvilinear envelope, the storage portion, the loops, the draw strings, and the cord locks are made of washable, recycled and recyclable material.

Example 2

A pillow case system comprises a curvilinear envelope with a first cavity, a storage portion with a second cavity, a securement system, and a loop on the curvilinear envelope. The perimeters of the storage portion are entirely within the perimeters of the curvilinear envelope. Elastic materials are used to tighten both the first cavity and the second cavity. The securement system is made of several loops of elastic material and is positioned in the middle of the curvilinear envelope such that it is equidistant from the left-most edge of the curvilinear envelope and the right-most edge of the curvilinear envelope. A carabiner clip is clipped onto the loop. The curvilinear envelope, the storage portion, and the loop are made of REPREVE®. The elastic materials used to tighten the first cavity, the second cavity and the middle of the curvilinear envelope are washable, recycled and recyclable. The pillow case system is made while complying with fair labor standards.

The following is claimed:

1. A pillow case system comprising:

a curvilinear envelope with a first cavity, wherein the first cavity is configured to receive a neck pillow when the pillow case system is in an open configuration, and wherein the first cavity is configured to receive a storage portion that is compressed;

a draw string around a first opening of the first cavity of the curvilinear envelope, wherein the draw string tightens the first opening of first cavity from an open position to a closed position;

a cord lock, wherein the cord lock secures the draw string in the open position or the closed position; and the storage portion comprising a second cavity, wherein the storage portion is attached to the curvilinear envelope at the first opening such that the first opening is an opening corresponding to both the curvilinear envelope and the storage portion, wherein the storage portion is configured to receive the entire curvilinear envelope into the second cavity when the pillow case system is in a stowed configuration, and wherein the draw string is configured to tighten the opening of the second cavity from the open position to the closed position after the curvilinear envelope is inserted into the second cavity; and a loop in the middle of the curvilinear envelope such that the weight of the pillow case system is equally distributed when the pillow case system is securely clipped onto another item while the pillow case system is in the open configuration.

2. The pillow case system of claim 1, further comprising a carabiner clip.

3. The pillow case system of claim 1, wherein the curvilinear envelope and the storage portion comprise REPREVE® material.

4. The pillow case system of claim 1, further comprising a securement system, wherein the securement system comprises a plurality of loops placed in the middle of the curvilinear envelope such that the plurality of loops secure positioning of the neck pillow when it is inserted into the curvilinear envelope.

5. The pillow case system of claim 4, wherein the plurality of loops comprises plastic bands.

6. The pillow case system of claim 1, wherein the loop is configured to securely clip the pillow case system onto another item by using a clip-on device.

7. The pillow case system of claim 6, further comprising a carabiner clip.

8. The pillow case system of claim 1, further comprising an elastic system around the first cavity, wherein the elastic system is configured to secure the neck pillow inside the pillow case system.

9. The pillow case system of claim 1, wherein the pillow case system is made of washable, recycled, and recyclable material.

10. The pillow case system of claim 1, further comprising an elastic system around the second cavity, wherein the elastic system is configured to secure the pillow case system inside the storage portion.

11. The pillow case system of claim 1, wherein the loop is configured to receive a carabiner clip.

* * * * *